US009022038B2

(12) United States Patent
Shakouri Moghadam et al.

(10) Patent No.: US 9,022,038 B2
(45) Date of Patent: May 5, 2015

(54) AIR SUCTION DEVICE FOR A SMOKING APPARATUS

(76) Inventors: Mohammad Mahdi Shakouri Moghadam, Tehran (IR); Mohammad Javad Shakouri Moghadam, Tehran (IR)

( * ) Notice: Subject to any disclaimer, the term of this patent is extended or adjusted under 35 U.S.C. 154(b) by 1059 days.

(21) Appl. No.: 13/083,621

(22) Filed: Apr. 11, 2011

(65) Prior Publication Data

US 2012/0255566 A1 Oct. 11, 2012

(51) Int. Cl.
*A24F 1/30* (2006.01)

(52) U.S. Cl.
CPC ..... *A24F 1/30* (2013.01)

(58) Field of Classification Search
CPC ..... A24F 1/30
USPC ..... 131/173; 15/344
See application file for complete search history.

(56) References Cited

U.S. PATENT DOCUMENTS 4,218,806 A * 8/1980 Cohn ..... 15/402
4,268,288 A * 5/1981 Coombs ..... 55/337
4,536,914 A * 8/1985 Levine ..... 15/344
4,573,234 A * 3/1986 Kochte et al. ..... 15/323
4,610,048 A * 9/1986 Ishihara et al. ..... 15/344
4,821,366 A * 4/1989 Levine ..... 15/344
4,956,892 A * 9/1990 Fawkes ..... 15/339
5,065,473 A * 11/1991 Krasznai et al. ..... 15/339
7,730,576 B1 * 6/2010 Snyder ..... 15/344
2007/0220699 A1 * 9/2007 Mersmann et al. ..... 15/323
2007/0261194 A1 * 11/2007 Tannous ..... 15/330
2010/0180398 A1 * 7/2010 Casper ..... 15/344

* cited by examiner

*Primary Examiner* — Richard Crispino
*Assistant Examiner* — Eric Yaary
(74) *Attorney, Agent, or Firm* — Barry Choobin; Patent 360 LLC

(57) ABSTRACT

The various embodiments herein provide an air suction device for a smoking apparatus. The air suction device comprises a cylindrical housing, an impeller, an impeller cover, a motor assembled inside the housing to drive the impeller, a plurality of batteries provided in the housing, a battery cover to enclose the plurality of batteries and a switch provided externally to the cylindrical housing. When the switch is in ON condition, the plurality of batteries supply an electrical power to the motor and the motor converts the electrical power into a mechanical power which in turn causes propulsion of the impeller thereby sucking out the air from a water bowl of the smoking apparatus. The propulsive motion of the impeller sucks out the air from the water bowl until the air inside the water bowl is replaced by condensed smoke.

5 Claims, 2 Drawing Sheets

AIR SUCTION DEVICE FOR A SMOKING APPARATUS

BACKGROUND

1. Technical Field

The embodiments herein generally relate to a smoking apparatus and particularly relates to a tool used for smoking the hookah. The embodiments herein more particularly relates to an air suction device to replace air with condensed smoke in the water bowl of the smoking apparatus.

2. Description of the Related Art

Application history of the tobacco returns to many years ago and smoking plants for medical purposes and use of plants holding a tranquilizer or ataractic agents is common. The currently available smoking apparatus, with a small water reservoir in a lower section and tobacco in an upper section within a ceramic container placed over the smoking apparatus, has an antiquity of hundreds of years. In the smoking apparatus, a suction imposes negative pressure and creates an airflow starting from the upper section of tobacco. The airflow passes through the blazing charcoal over the head of the smoking apparatus. The stroke of hot air with tobacco pieces placed underneath the charcoal results in a quick raise of the temperature of the tobacco pieces and the increase in temperature increase is accompanied with an evaporation of the materials existing in the tobacco. The vapor enters into the water in the form of a white smoke through a pipe of the smoking apparatus and then to the upper section of the water container and comes out of the smoking apparatus with next suctions. The use of water in the lower section of the smoking apparatus reduces temperature of outgoing gases and the positive pressure imposed on the air coming out through the pipe gives much pleasure to the smoker.

Existing techniques includes a water pipe having a single, vertical, elongate open pipe sealed at the bottom, a bowl for burning the organic substance, a single tube used for mounting the bowl and leading at an angle into the elongated pipe near its bottom. Water is poured into the elongated pipe to a level just above the junction of the open pipe and the bowl tube so that, smoke is bubbled through the water to cool and clean it when the smoker draws a smoke through the pipe. The smoke is further cooled by expansion in the wide elongate pipe. Thus the elongate pipe operates as a combined water and inhalation chamber. To clear a smoke from the chamber of most common water pipes, the entire bowl needs to be removed. More sophisticated pipes with a small diameter hole known as a "shotgun" is provided in the elongated pipe just above the water level to facilitate an inhalation of the smoke from the chamber. This hole, if present, is kept closed by the smoker's finger during the initial stages of a smoking session. When the elongated pipe is filled with smoke, the hole is opened and the smoke is driven into the lungs with a ram effect.

There are several disadvantages that exist with the conventional smoking apparatus. The smoker needs to close the small hole provided on the elongated pipe during the initial stages of a smoking session until the elongate pipe gets completely filled with smoke. The smoker needs to wait for some time to smoke the tobacco until the elongate pipe gets completely filled with the smoke. Furthermore, with the traditional smoking apparatus, the smoker needs to apply a primary pressure to suck an air filled in the water bowl until the water bowl is completely filled with the condensed smoke. The primary pressure is borne by the smoker's lung to smoke.

Hence there is a need to provide an air suction device for the smoking apparatus to reduce a prolonged waiting time required to expel the air from the water bowl of the smoking apparatus for smoking. There also exists a need to provide an air suction device which eliminates the need for applying immense pressure by the smoker to expel air from the water bowl of the smoking apparatus. Moreover, there exists a need to provide an air suction device for the smoking apparatus to facilitate the activation of the air suction process until the air is completely expelled from the water bowl and deactivation of the air suction process when the water bowl is completely filled with the condensed smoke.

The abovementioned shortcomings, disadvantages and problems are addressed herein and which will be understood by reading and studying the following specification.

OBJECTS OF THE EMBODIMENTS

The primary object of the embodiments herein is to provide an improved air suction device for a smoking apparatus to suck out air filled inside the water bowl of the smoking apparatus.

Another object of the embodiments herein is to provide an air suction device for a smoking apparatus to eliminate a need for prolonged waiting time to expel air from the water bowl of the smoking apparatus for smoking.

Yet another object of the embodiments herein is to provide an air suction device for a smoking apparatus to eliminate a need for applying a primary pressure by the smoker to expel an air from the water bowl of the smoking apparatus.

Yet another object of the embodiments herein is to provide an air suction device for a smoking apparatus to prevent the smokeless inhalation at the initial stage of smoking.

Yet another object of the embodiments herein is to provide an air suction device for a smoking apparatus to enable effortless adjustment of the smoking apparatus by the user.

Yet another object of the embodiments herein is to provide an air suction device for a smoking apparatus to prevent wastage of smoking material.

These and other objects and advantages of the embodiments herein will become readily apparent from the following detailed description taken in conjunction with the accompanying drawings.

SUMMARY

The various embodiments herein provide an air suction device for a smoking apparatus. The air suction device comprises a cylindrical housing, an impeller, an impeller cover, a motor assembled inside the housing to drive the impeller, a plurality of batteries provided in the housing, a battery cover to enclose the plurality of batteries and a switch provided externally to the cylindrical housing. When the switch is in ON condition, the plurality of batteries supply an electrical power to the motor and the motor coverts the electrical power into a mechanical power which in turn causes impeller propulsion thereby sucking out the air from a water bowl of the smoking apparatus.

According to an embodiment herein, a parallel connection of the plurality of batteries generates a power of 2/4 voltage for driving the motor. Similarly, when the plurality of batteries are connected in series, the plurality of batteries generates a power of 4/8 voltage for driving the motor. The plurality of batteries is rechargeable and is made of at-least one of Nickel Cadmium and Nickel Metal Hybrid.

According to an embodiment herein, the cylindrical housing, battery cover and the impeller cover are made of Acrylonitrile butadiene styrene (ABS) polymer. The cylindrical housing comprises at least two halves joined together along a common cylindrical axis. The impeller cover is attached to the housing with a plurality of screw threads. The battery cover is built-in with the housing through injection molding.

According to an embodiment herein, the propulsive motion of the impeller replaces the air inside the water bowl with a condensed smoke by sucking out the air from the water bowl.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Although the specific features of the embodiments herein are shown in some drawings and not in others. This is done for convenience only as each feature may be combined with any or all of the other features in accordance with the embodiments herein.

DETAILED DESCRIPTION OF THE EMBODIMENTS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein provide an air suction device for a smoking apparatus. The air suction device comprises a cylindrical housing, an impeller, an impeller cover, a motor assembled inside the housing to drive the impeller, a plurality of batteries provided in the housing, a battery cover to enclose the plurality of batteries and a switch provided externally to the cylindrical housing. When the switch is in ON condition, the plurality of batteries supply an electrical power to the motor and the motor converts the electrical power into a mechanical power which in turn causes the propulsion of the impeller thereby sucking out the air from a water bowl of the smoking apparatus.

According to an embodiment herein, when a switch connects the plurality of batteries in parallel so the pluralities of batteries generate a power of 2/4 voltage for driving the motor. Similarly, when the switch connects the plurality of batteries in series, the plurality of batteries generates a power of 4/8 voltage for driving the motor. The plurality of batteries is rechargeable and is made of at-least one of Nickel Cadmium and Nickel Metal Hybrid.

According to an embodiment herein, the cylindrical housing, battery cover and the impeller cover are made of Acrylonitrile butadiene styrene polymer. The cylindrical housing comprises at least two halves joined together along a common cylindrical axis. The impeller cover is attached to the housing with a plurality of screw threads. The battery cover is built with the housing through an injection molding process.

According to an embodiment herein, the propulsion of the impeller replaces the air inside the water bowl with a condensed smoke by sucking out the air from the water bowl.

Figure 1:
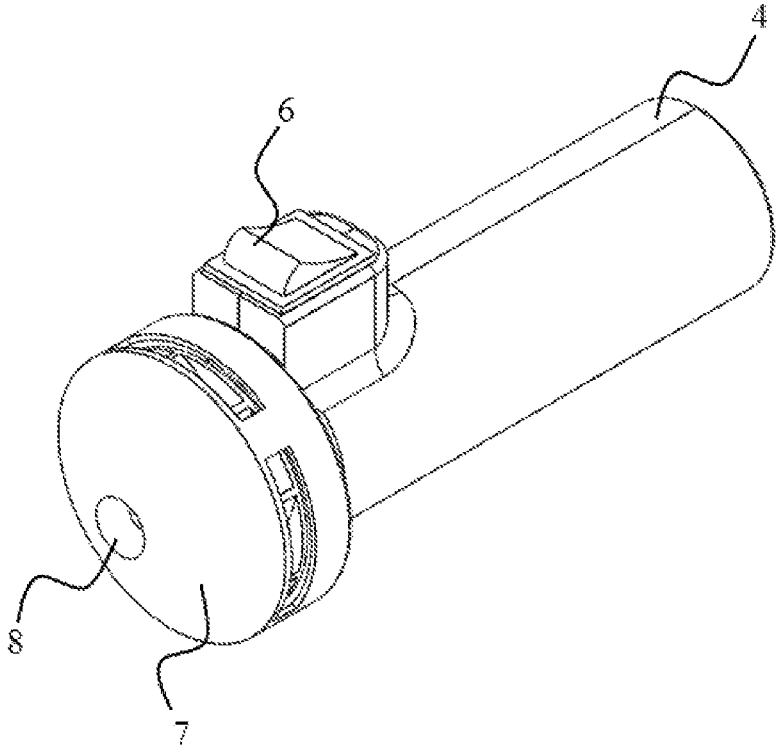
FIG. 1 illustrates a perspective view of an air suction device for the smoking apparatus, according to an embodiment herein.
Figure 2:
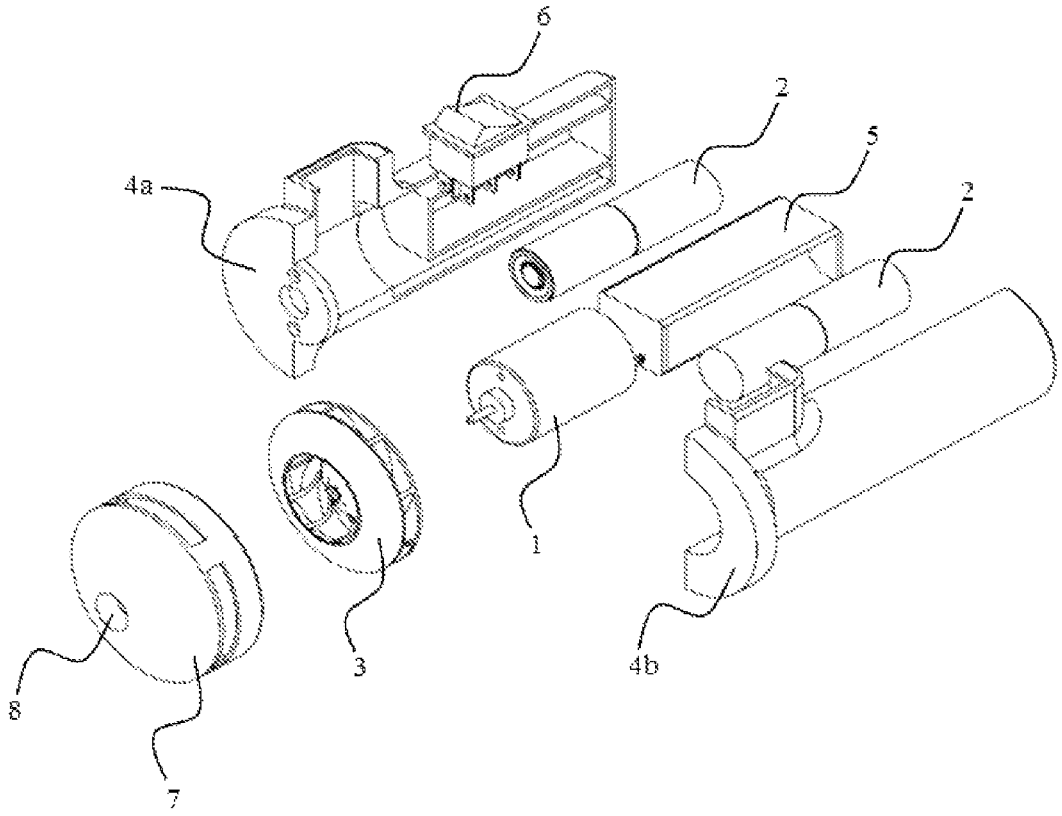
FIG. 2 illustrates an exploded perspective view of an air suction device for the smoking apparatus, according to an embodiment herein.

FIG. 1 illustrates a perspective view of the air suction device for the smoking apparatus, according to an embodiment herein. The smoking apparatus disclosed herein is directed towards a hookah. The last stage in the preparation for smoking in the smoking apparatus is a breathing process through the pipe until the condensed smoke appears in the water bowl. The air suction device of the present disclosure provides a simple and shortcut method to reach the point/stage where the water bowl of the smoking apparatus is completely filled with the condensed smoke and ready to be used by the smoker. The air suction device is a tool connected to the pipe of the smoking apparatus (not shown) for smoking. The air suction device comprises a cylindrical housing 4, a switch 6, an impeller housed inside an impeller cover 7 and attached to the cylindrical housing 4, a switch 6 arranged on the outer surface of the cylindrical housing 4 and an air out let 8 provided on the cylindrical housing 4. The air suction device further includes a motor, a plurality of batteries (as shown in FIG. 2) provided inside the cylindrical housing 4.

During a smoking process, the air present inside at different internal parts/areas of the smoking apparatus gets completely discharged through the output hose by a suction process. The air suction device of the embodiments herein sucks the air filled inside the different internal parts of the smoking apparatus including the water bowl of the smoking apparatus.

The air suction device is activated when the smoker switches ON the switch 6 provided on the cylindrical housing 4 of the air suction device. When the switch 6 is turned on, the plurality of batteries are connected either in parallel or a series. The parallel connection of the plurality of batteries generates an electrical current of 2/4 Ampere and the series connection generates an electrical current of 4/8 Ampere which is directed to the motor. The motor converts the current into mechanical motion and forces the impeller to propel. The motion of the impeller results in sucking out the air inside the water bowl and replacing the air with smoke. Once the smoke appears in the water bowl, the smoking apparatus is ready for use.

The switch 6 is kept in ON condition until the air filled inside the water bowl is completely exhausted and replaced by the condensed smoke. The air suction device herein acts as the human lung to expel the air filled inside the different parts of the smoking apparatus. The switch 6 is turned OFF, when the water bowl of the smoking apparatus is completely filled with the condensed smoke and the smoking apparatus is ready to use. When the smoker places his/her lips on the output hose for inhaling the condensed smoke, only the condensed smoke with sufficient concentration is fed from the output hose. The air suction process by the air suction device causes a temperature of a charcoal of the smoking apparatus to reach a very high temperature and consequently the temperature of tobacco is also increased and smoke is generated.

FIG. 2 illustrates an exploded view of the air suction device for the smoking apparatus, according to an embodiment of the present disclosure. The air suction device comprises a motor 1, a plurality of batteries 2, an impeller 3, a cylindrical housing, a battery cover 5, a switch 6, an impeller cover 7 and an air outlet 8.

The motor 1 is a high torque motor (up to 19000 rpm) which enables to use a smaller impeller 3 (68 mm in diameter) which in turn reduces the size of the air suction device as a whole. The diameter of the motor 1 is approximately 36 mm and the length is about 50 mm. The motor 1 operates at 6V and consumes 6 A-7 A of the power supply generated from the plurality of batteries 2. The plurality of batteries 2 is nickel cadmium (NiCad) and nickel metal hybrid (NiMH) batteries. The plurality of batteries 2 supplies high electrical current (6 A-7 A) which is needed to run the motor 1. The plurality of batteries 2 are cheap and safe to use and moreover rechargeable using 220 Voltage power. The plurality of batteries 2 are secured in a battery cover 5. According to an embodiment herein, the battery cover 5 is built up through an injection molding process.

The impeller 3 increases the air flow and expels the air inside the different parts including the water bowl of the smoking apparatus upon propulsion and fills the water bowl with the condensed smoke. The impeller 3 is secured inside the impeller cover 7. The impeller cover 7 is made of Acrylonitrile butadiene styrene (ABS) polymer. The acrylonitrile butadiene styrene (ABS) polymer combines the strength and rigidity of the acrylonitrile and styrene polymers with the toughness of the polybutadiene rubber. The air suction device is activated when the smoker turns ON the switch 6 provided on the cylindrical housing of the air suction device. When the switch 6 is turned on, the plurality of batteries are connected either in parallel or a series. The plurality of batteries connected in parallel generates an electrical current of 2/4 Ampere and the plurality of batteries connected in series generates an electrical current of 4/8 Ampere which is directed to the motor. The motor 1 converts the current into mechanical motion and forces the impeller to rotate. The rotation of the impeller 3 results in sucking out the air inside the water bowl and replacing the air with smoke. Once the smoke appears in the water bowl, the smoking apparatus is ready for use.

The cylindrical housing is divided into two parts 4*a* and 4*b* along the cylinder axis of the body. The impeller cover 7 is a separate part attached to the cylindrical housing screw threads. The cylindrical housing, the impeller cover 7 and the battery cover 5 are attached together to form a single body.

The switch 6 of the air suction device is a double pole 3-phase switch 6 which enables the smoker to use the device in two different speeds. The switch 6 is able to pass a current of 6 Amperes. The switch 6 connects the plurality of batteries 2 in two different ways such as in a parallel connection and a series connection. When the plurality of batteries 2 are connected in parallel, the output power for the motor 1 is 2/4 Voltage, while the plurality of batteries 2 are connected in series, the output power for the motor 1 is 4/8 Voltage. Accordingly, the durability of the plurality of batteries 2 in slow revolution mode is twice comparing with that of the fast revolution mode.

One of the advantages of the proposed air suction device is that the air suction device avoids the primary pressure which should be borne by the human lungs to smoke. The air suction device eliminates the need for applying a primary pressure by the smoker to expel air from the water bowl of the smoking apparatus. The air suction device of the embodiment herein eliminates the need for a prolonged waiting time to expel an air from the water bowl of the smoking apparatus for smoking. The embodiments herein facilitate an easy replacement of any part in case of damage. The embodiment disclosed herein is suitable for operation and use in any climate.

The mechanical properties of ABS used for the impeller cover, cylindrical housing and battery housing are impact resistance and toughness. ABS also has electrical properties that are constant over a wide range of frequencies. Further ABS also permits application of metal plating on it.

The embodiment herein avoids beginning dangerous smokeless inhalation and pressure forced to the lungs of the user to prepare tobacco for smooth smoking. The embodiment herein provides an effortless smoking readjustment and complete use of tobacco. The air suction device of the embodiments herein is a mobile, chargeable, affordable and light weight.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

Although the embodiments herein are described with various specific embodiments, it will be obvious for a person skilled in the art to practice the embodiments herein with modifications. However, all such modifications are deemed to be within the scope of the claims.

It is also to be understood that the following claims are intended to cover all of the generic and specific features of the embodiments described herein and all the statements of the scope of the embodiments herein which as a matter of language might be said to fall there between.

What is claimed is:

1. A smoking apparatus comprising a water bowl and an air suction device, the air suction device further comprising:

a cylindrical housing;

an impeller configured to generate propulsion, and wherein the impeller is secured inside an impeller cover;

a motor configured to drive the impeller, wherein the motor is operated with a power supply generated by a plurality of batteries, wherein the plurality of batteries are connected in series or in parallel by a switch to vary an electrical current supplied to the motor to operate the motor in two different speeds, wherein the plurality of batteries generate an electrical current of 2/4 ampere for driving the motor when the switch connects the plurality of batteries in parallel, and the plurality of batteries generate an electrical current of 4/8 ampere for driving the motor when the switch connects the plurality of batteries in series, and wherein the switch is a double pole three phase switch;

a battery cover for enclosing the plurality of batteries;

wherein the air suction device is configured to suck out air accumulated in the water bowl of the smoking apparatus by using a force created by the propulsion, in the event that the impeller is propelled by the motor, and wherein the air suction device is further configured to enable automatic expulsion of air from the water bowl and replacement of air in the water bowl by condensed smoke, without necessitating application of external sucking pressure by a smoker's lungs and to prevent smokeless inhalation, wherein the switch is kept in an ON condition until the air in the water bowl is completely exhausted and replaced with condensed smoke, and wherein the smoking apparatus is a hookah device.

2. The smoking apparatus of claim 1, wherein the plurality of batteries comprise at least one of Nickel Cadmium and Nickel Metal Hybrid batteries.

3. The smoking apparatus of claim 1, wherein the plurality of batteries are rechargeable batteries.

4. The smoking apparatus of claim 1, wherein the cylindrical housing, the battery cover and the impeller cover are made of Acrylonitrile butadiene styrene polymer.

5. The smoking apparatus of claim 1, wherein the cylindrical housing comprises at least two halves joined together along a common cylindrical axis.

* * * * *